US011000740B2

(12) United States Patent
Burke

(10) Patent No.: US 11,000,740 B2
(45) Date of Patent: May 11, 2021

(54) BALL RETRIEVAL ATTACHMENT FOR GOLF FLAGSTICK

(71) Applicant: James Burke, Sarasota, FL (US)

(72) Inventor: James Burke, Sarasota, FL (US)

( * ) Notice: Subject to any disclaimer, the term of this patent is extended or adjusted under 35 U.S.C. 154(b) by 0 days.

(21) Appl. No.: 16/819,013

(22) Filed: Mar. 13, 2020

(65) Prior Publication Data

US 2020/0398117 A1 Dec. 24, 2020

Related U.S. Application Data

(60) Provisional application No. 62/865,663, filed on Jun. 24, 2019.

(51) Int. Cl.

| | |
|---|---|
| ***A63B 47/02*** | (2006.01) |
| ***A63B 57/40*** | (2015.01) |
| *A63B 63/00* | (2006.01) |
| *A63B 102/32* | (2015.01) |

(52) U.S. Cl.

CPC ..... *A63B 47/02* (2013.01); *A63B 57/40* (2015.10); *A63B 2063/001* (2013.01); *A63B 2102/32* (2015.10)

(58) Field of Classification Search

CPC ..... A63B 47/02; A63B 57/357; A63B 57/40; A63B 2102/32; A63B 2063/001

USPC ..... 294/19.2; 473/177

See application file for complete search history.

(56) References Cited

U.S. PATENT DOCUMENTS

| | | | | |
|---|---|---|---|---|
| 979,313 A | | 12/1910 | King et al. | |
| 1,470,603 A | | 10/1923 | DuBois | |
| 1,538,822 A | * | 5/1925 | Kennedy | A63B 57/40 473/176 |
| 1,599,734 A | | 9/1926 | Wilson | |
| 1,829,283 A | | 10/1931 | Kip | |
| 2,684,245 A | * | 7/1954 | Jacoby | A63B 57/357 473/176 |
| 2,929,628 A | | 3/1960 | Lane | |
| 3,572,707 A | | 3/1971 | Stapleton, Jr. | |
| 3,790,166 A | | 2/1974 | Hamilton et al. | |
| 5,393,053 A | | 2/1995 | Wiese et al. | |

(Continued)

FOREIGN PATENT DOCUMENTS

| | | |
|---|---|---|
| GB | 373054 A | 5/1932 |
| GB | 449776 A | 7/1936 |

OTHER PUBLICATIONS

"4 sets of A99 Golf Practice Putting Flagstick w. Hole Cup 90cm (2 Blue + 2 White)," Amazon.com, Inc. website: www.amazon.com/A99-Golf-Practice-Putting-Flagstick/dp/B077CL5XXG/ref=asc_df_B077CL5XXG/?tag=hyprod-20&linkCode=df0&hvadid=312104197194&hvpos=1o1&hvnetw=g&hvrand=16774411009004782533&hvpone=&hvptwo=&hvqmt=&hvdev=c&hvdvcmdl=&hvlocint=&hvlocphy=9007556&hvtargid=pla-570917802716&psc=1.

*Primary Examiner* — Dean J Kramer
(74) *Attorney, Agent, or Firm* — Nath, Goldberg & Meyer; Richard C. Litman

(57) ABSTRACT

The golf flagstick with ball retrieval attachment is designed to assist a player in removing a golf ball from a golf cup after the player has played the ball into the cup. The golf flagstick includes a flag mounted proximate a top end of the golf flagstick and a ball retrieval attachment mounted proximate a bottom end of the golf flagstick. The ball retrieval attachment includes a ball retrieval body mounted on the flagstick using a ball retrieval fastener and adjustment mechanism. The ball retrieval fastener and adjustment mechanism allows for height adjustable attachment of the ball retrieval body on the flagstick to compensate for different golf cup depths.

12 Claims, 8 Drawing Sheets

(56) References Cited

U.S. PATENT DOCUMENTS

| | | | | |
|---|---|---|---|---|
| 6,939,239 | B1 * | 9/2005 | Ash | A63B 71/028 473/176 |
| 10,471,316 | B1 * | 11/2019 | Bartlett | A63B 47/02 |
| 2008/0171609 | A1 * | 7/2008 | Priegel | A63B 57/40 473/176 |
| 2016/0320050 | A1 * | 11/2016 | Barnhart | A63B 69/36 |

* cited by examiner

BALL RETRIEVAL ATTACHMENT FOR GOLF FLAGSTICK

CROSS-REFERENCE TO RELATED APPLICATION

This application claims the benefit of U.S. Provisional Patent Application Ser. No. 62/865,663, filed Jun. 24, 2019.

BACKGROUND

1. Field

The disclosure of the present patent application relates to golf accessories, and particularly to a ball retrieval attachment for golf flagstick for use with putting greens.

2. Description of the Related Art

In the past, the Professional Golfers' Association (PGA) rules required removal of the golf flagstick from the cup once a player's ball is on the green and prior to putting. As of Jan. 1, 2019, PGA rules allow the golf flagstick to remain in the cup, eliminating the penalty for hitting the flagstick for a putt made from the green. The change was made to speed up the game, especially for golfers who play without a caddy. However, with the flagstick left in the cup, it can be difficult for some golfers to remove the flagstick from the cup with one or more golf balls in the cup; conversely, it may be difficult for some golfers to reach into a cup that is now crowded with the presence of the flagstick in order to retrieve one or more golf balls. While some ball retrieval mechanisms on golf flagsticks have been proposed, they do not provide adjustability and removability while also meeting the strict rules of the PGA.

Thus, a ball retrieval attachment for golf flagstick solving the aforementioned problems is desired.

SUMMARY

The ball retrieval attachment for golf flagstick is designed to assist a player to remove a golf ball from a golf cup (or hole) after the player (or players) has used his/her golf club or putter to place the ball in the cup. The ball retrieval attachment may be retrofitted on an existing golf flagstick, or may be manufactured integrally with a golf flagstick. The golf flagstick includes a conventional flag mounted proximate the top end of the golf flagstick and a ball retrieval mechanism mounted proximate the bottom end of the golf flagstick. The ball retrieval attachment includes a ball retrieval body mounted on the flagstick using a ball retrieval fastener and adjustment mechanism. The ball retrieval body may be a conical or concave annular disk made of a fibrous material that supports the ball, but allows for water to drain through the ball retrieval body. Alternatively, the ball retrieval body may be made of a flexible, polymeric material, metallic mesh or memory wire. The ball retrieval body may also include a plurality of reinforcement ribs for additional support. To support an outer rim or perimeter of the ball retrieval body, a memory spring wire may be attached to the outer rim of the ball retrieval body. The ball retrieval fastener and adjustment mechanism allows for height adjustable attachment of the ball retrieval body on the flagstick.

In a first embodiment, the ball retrieval attachment and adjustment mechanism may include a ball retrieval attachment hub and a common hose clamp with a screw-activated clamp mechanism. One example of a suitable hose clamp is shown in U.S. Pat. No. 4,521,940, issued to Oetiker on Jun. 11, 1985, which is hereby incorporated by reference in its entirety. In a further embodiment, the ball retrieval attachment hub may be adhesively attached to the flagstick in the factory, once it is adjusted to the proper height. Alternatively, the ball retrieval attachment may be provided as a stand-alone aftermarket attachment that may be used to retrofit existing conventional flagsticks with the ball retrieval attachment, without the need to modify the flagstick.

In a second embodiment, the ball retrieval fastener and adjustment mechanism includes a ball retrieval attachment hub having female (or internal) threads that engage male (or external) threads formed on the bottom of the flagstick. In this embodiment, the flagstick (existing or new) is modified to include the external threads, and the reinforcement ribs provide additional strength and a raised surface that can be used to assist in threading the ball retrieval attachment onto and off of the flagstick. A set screw may extend through a sidewall of the ball retrieval fastener and adjustment mechanism to fasten the ball retrieval attachment to the external threads at a desired height above the bottom of the flagstick. In this embodiment, an extender may be used to coarsely adjust the height (or distance) of the ball retrieval attachment above the flagstick ferrule bottom to compensate for different golf cup depths.

In a third embodiment, the ball retrieval attachment is an integral unit including the ball retrieval attachment hub with internal threads, a frustoconical ball engagement flange, and a cylindrical riser portion between the ball retrieval attachment hub and the ball engagement flange. In this embodiment, the height of the riser portion provides the coarse adjustment of the height of the ball engagement flange above the flagstick ferrule bottom. As in the previous embodiment, a set screw may extend through a sidewall of the ball retrieval attachment hub to fasten the ball retrieval attachment to the external threads at a desired height above the bottom of the flagstick ferrule.

In both the second and third embodiments, the external threads may be formed integrally on the flagstick ferrule at the bottom of the flagstick. Alternatively, the ball retrieval attachment for golf flagstick may include a slightly tapered flagstick ferrule with integral external threads, the ferrule defining a longitudinal bore. The ferrule can be attached to an existing flagstick using an adhesive or other attaching mechanism to retrofit the ball retrieval attachment onto the flagstick. It may be required to cut the existing ferrule off of the flagstick, prior to installing the new ferrule onto the flagstick.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
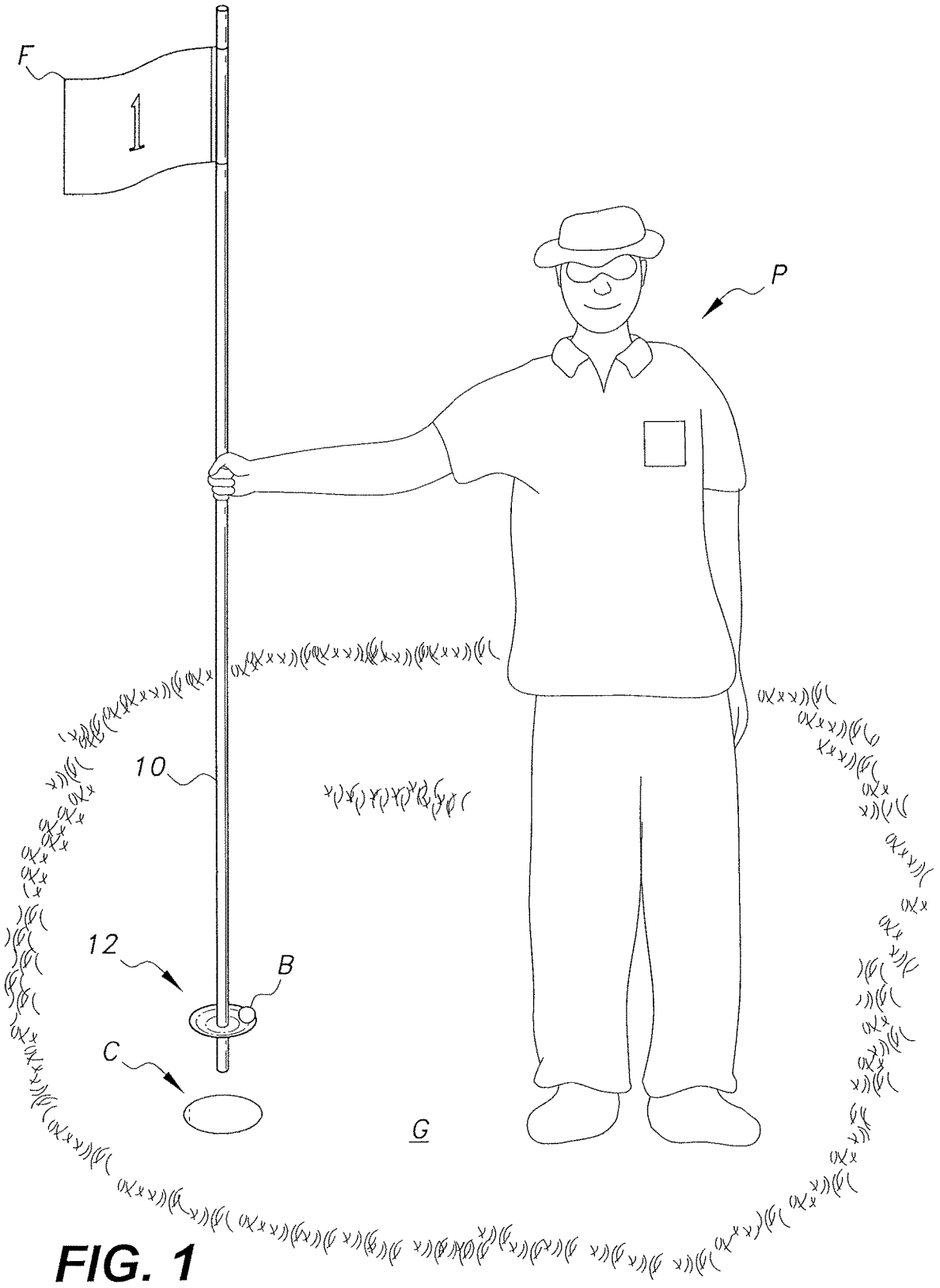
FIG. 1 is an environmental, perspective view of a ball retrieval attachment for golf flagstick, attached to a flagstick and being used by a player to retrieve a golf ball.

In FIG. 1, the ball retrieval attachment 12 for golf flagstick is shown mounted on a golf flagstick 10 and being used by a player P to remove a ball B from a golf cup C on a putting green G. The golf flagstick 10 includes a conventional flag F mounted proximate the top end of the golf flagstick 10, and the ball retrieval mechanism 12 mounted proximate the bottom end of the golf flagstick 10.

Figure 2:
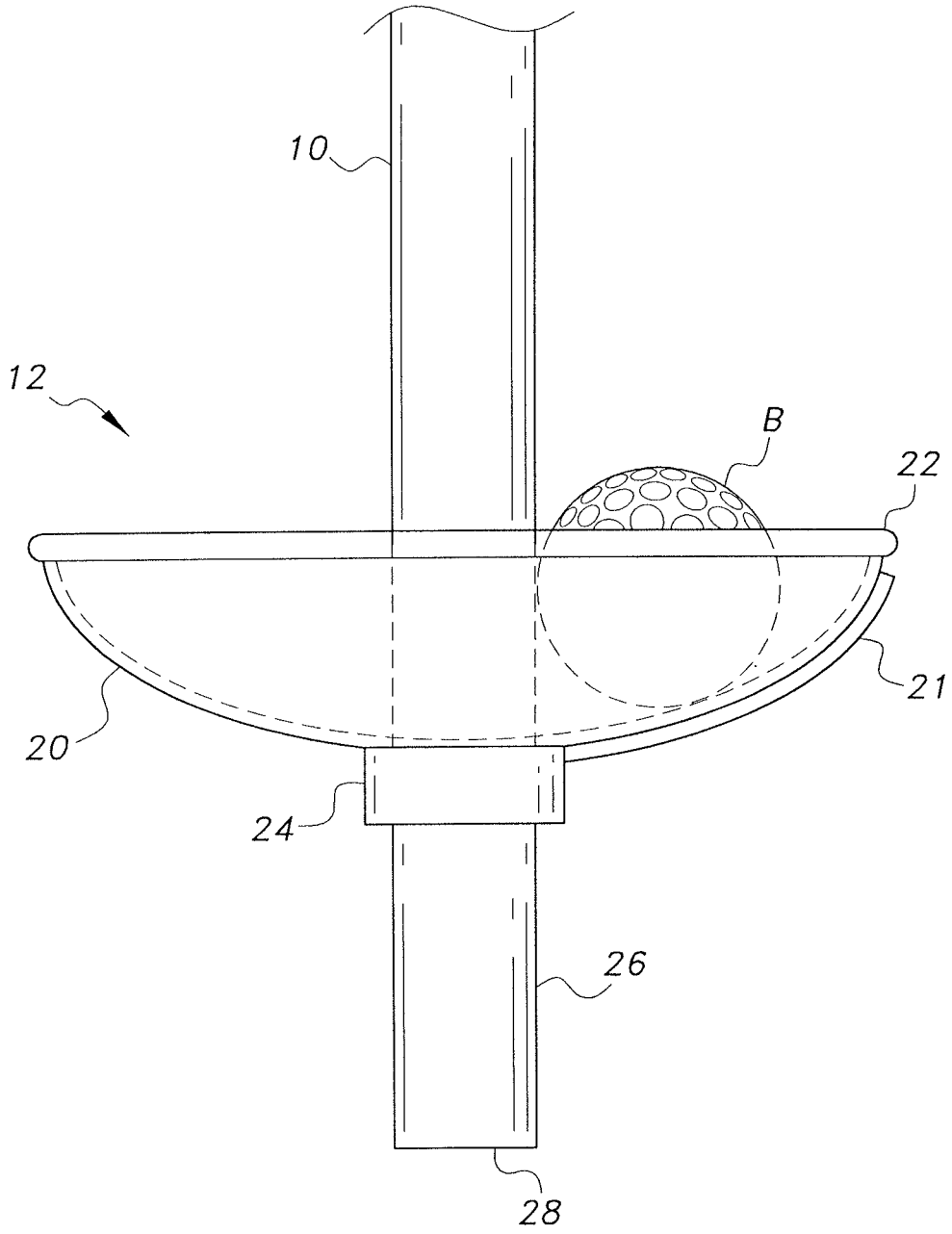
FIG. 2 is a partial enlarged front view of the ball retrieval attachment for golf flagstick of FIG. 1, showing details of the ball retrieval attachment.
Figure 3:
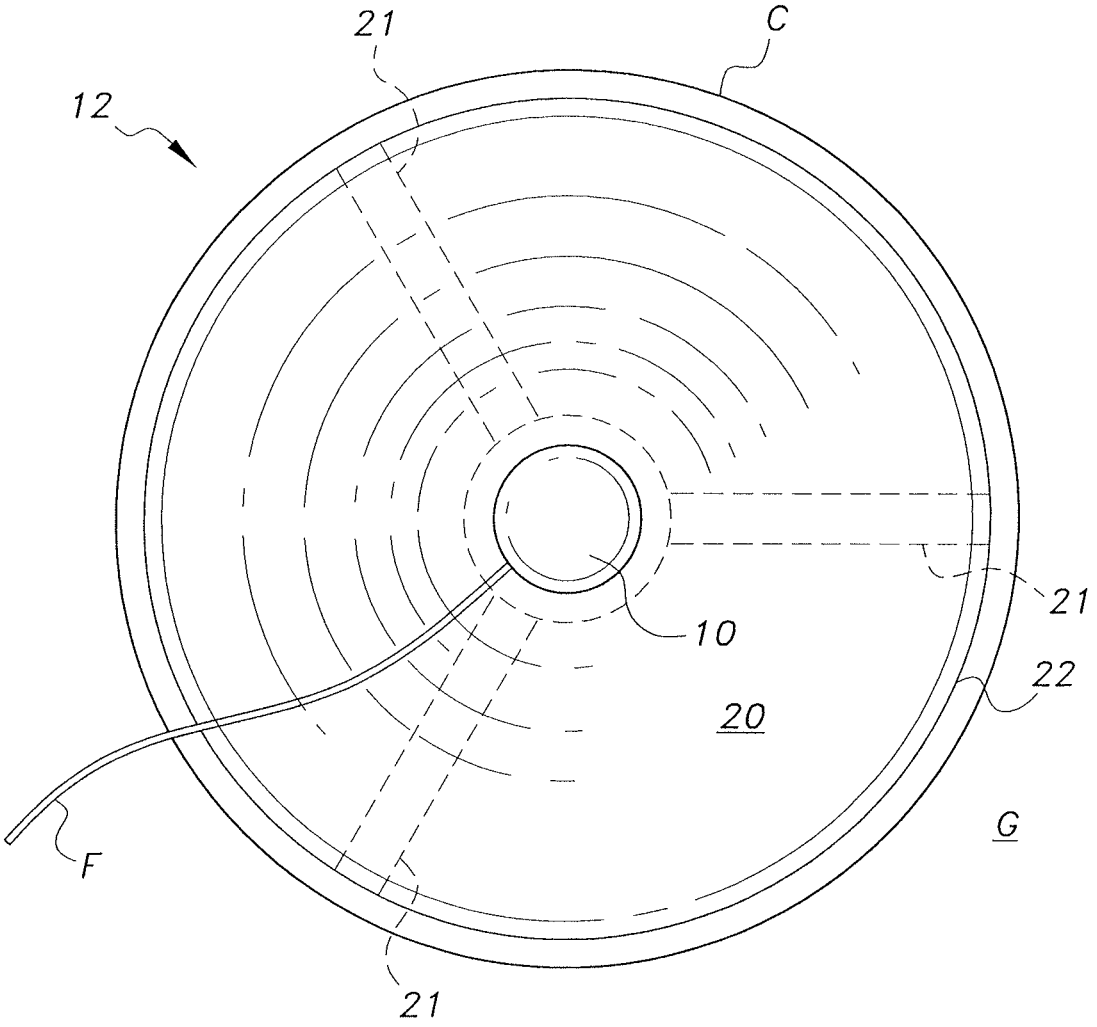
FIG. 3 is a diagrammatic environmental top view of the ball retrieval attachment for golf flagstick of FIG. 1, shown inserted in a golf cup.
Figure 4:
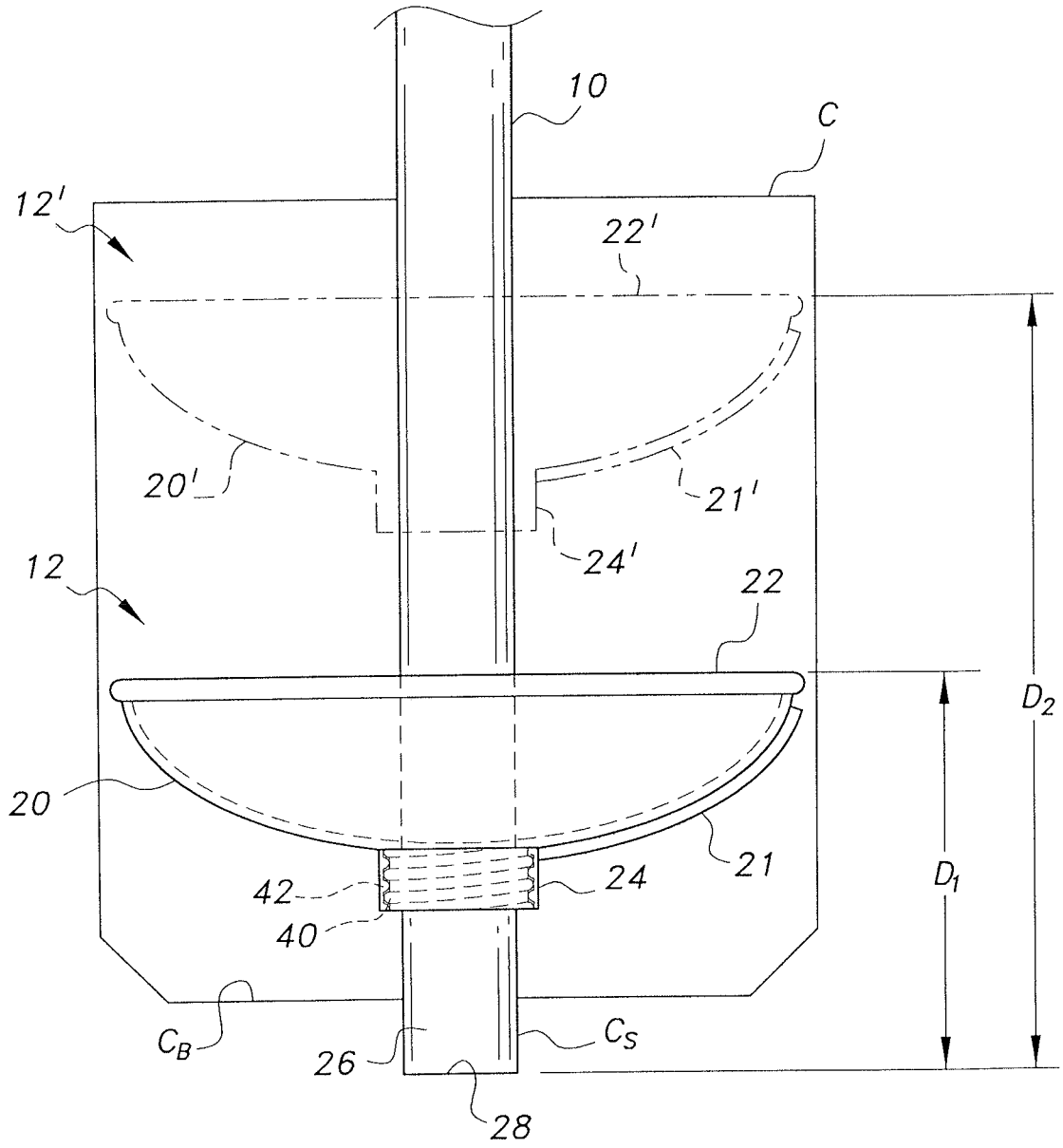
FIG. 4 is a partial diagrammatic environmental section view of the ball retrieval attachment for golf flagstick of FIG. 1, showing the ball retrieval attachment inserted in a golf cup.

The details of the ball retrieval attachment 12 for golf flagstick are shown in FIGS. 2-4. As shown in FIG. 2, the ball retrieval attachment 12 includes a ball retrieval body 20 mounted on the flagstick 10 using a ball retrieval fastener/adjustment mechanism 24. The ball retrieval body 20 is a conical or concave annular disk that may be made of a fibrous material that supports the ball B, but allows for water to drain through the ball retrieval body 20. Alternatively, the ball retrieval body 20 may be made of a flexible, polymeric material. To assist in supporting the ball retrieval body 20, three or more reinforcement ribs 21 extending radially from the central hub of the body 20 may be provided. In addition, to further support the outer rim (perimeter) of the ball retrieval body 20, a memory spring wire 22 may be attached to the outer rim of the ball retrieval body 20. The soft, yielding nature of the fibrous material (or of the flexible, polymeric material) avoids damage to the green G should a player wish to remove the flagstick 10 from the cup C and place it on the green G. The ball retrieval fastener/adjustment mechanism includes ball retrieval attachment hub 24 that allows for height adjustable attachment and support of the ball retrieval body 20 on the flagstick 10. In a first embodiment, the ball retrieval attachment hub 24 may be attached using a common hose clamp with a screw-activated clamp mechanism to clamp the ball retrieval attachment hub 24 to the flagstick 10. If future adjustment is not needed, the ball retrieval attachment hub 24 may be adhesively attached to the flagstick 10. Such an embodiment provides for retrofitting the ball retrieval attachment 12 onto existing conventional flagsticks without the need to modify the flagstick. As is known with most flagsticks, the bottom of the golf flagstick 10 includes a flagstick ferrule 26 for insertion into a cup socket $C_S$ located in the cup bottom $C_B$ of the golf cup C to support the golf flagstick 10 in a vertical orientation (see FIG. 4).

As best seen in FIG. 4, in a second embodiment, the ball retrieval attachment hub 24 includes internal threads 42 defined in a central hub that engage external threads 40 that are formed on the flagstick ferrule 26 at the bottom of the flagstick 10. In this embodiment, the reinforcement ribs 21 provide additional strength and a raised surface that can be used to assist in threading the ball retrieval attachment 12 onto and off of the flagstick 10. A lock mechanism (which may be a set screw, similar to the set screw 74 shown in the embodiment of FIG. 7, or other fastener) may be used to lock internal threads 42 to the external threads 40 at a user-selectable height to further secure the ball retrieval body 20 to the flagstick 10. In a first position, the top of the ball retrieval attachment 12 is a distance $D_1$ above the flagstick ferrule bottom 28. In a second position, the top of the ball retrieval attachment 12' is a distance $D_2$ above the flagstick ferrule bottom 28. In this embodiment, an extender 50 (shown in FIG. 5) may be used to coarsely adjust the height (or distance) of the ball retrieval attachment 12 above the flagstick ferrule bottom 28. The lock mechanism may be used to provide finer adjustment of this distance. In the first embodiment, to adjust this position, the screw of the hose clamp is loosened and the ball retrieval attachment 12 is slid along the length of the flagstick 10 to its desired position. The screw of the hose clamp is then tightened to maintain the ball retrieval attachment 12 in its desired position relative to the flagstick ferrule bottom 28. In most embodiments of the ball retrieval fastener/adjustment mechanism 24, the mechanism 24 allows the ball retrieval body 20 to be removed from the golf flagstick 10 temporarily, to comply with tournament and/or PGA rules, if necessary.

Figure 5:
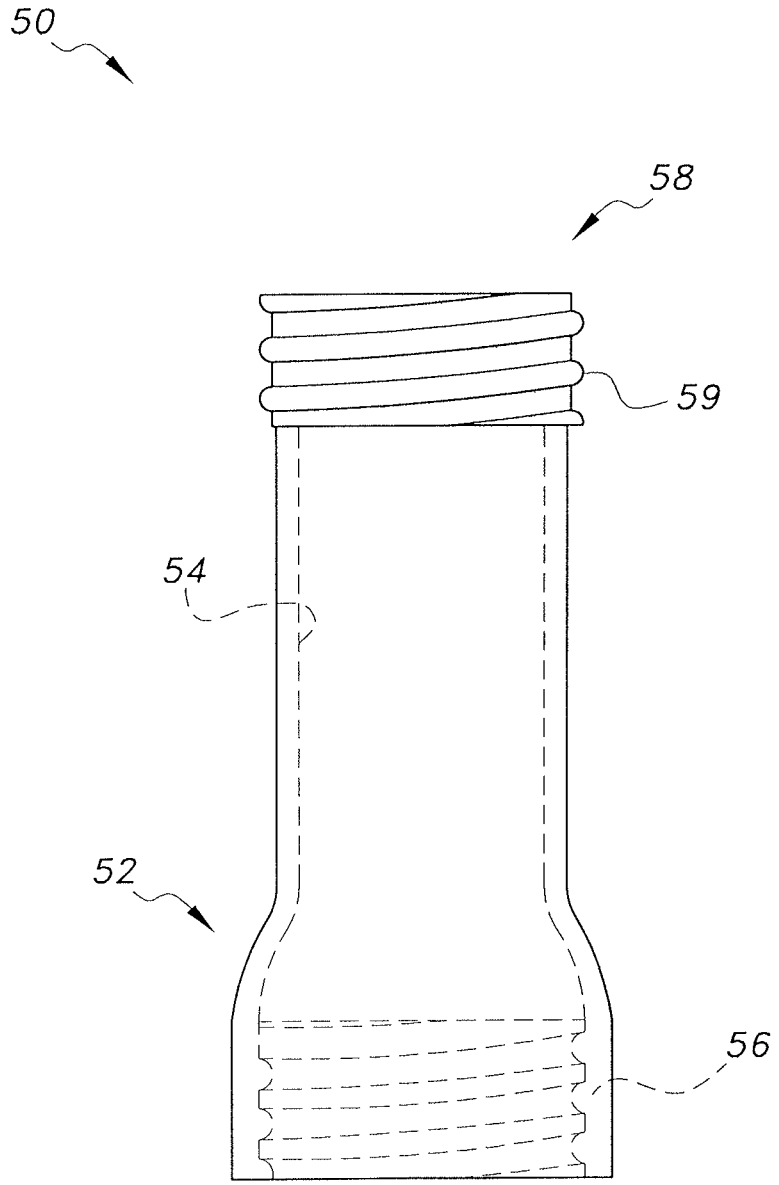
FIG. 5 is a side view of an extender for use with the ball retrieval attachment for golf flagstick of FIG. 1.

The details of the extender 50 are shown in FIG. 5. The extender 50 includes an axial bore 54, through which the flagstick 10 extends. The lower end 52 of the bore 54 includes internal threads 56, that engage the external threads 40 (FIG. 4) on the flagstick ferrule 26. The upper end 58 of the extender 50 includes external threads 59 that are engaged by the ball retrieval attachment's internal threads 42. By providing extenders of different lengths, the height of the ball retrieval attachment 12 above the flagstick ferrule bottom 28 can be adjusted. In this embodiment, the flagstick 10 is modified to include the external threads 40 as an integral part of the flagstick ferrule 26, or the external threads 40 may be adhesively or otherwise attached to an existing flagstick ferrule 26.

Figure 6:
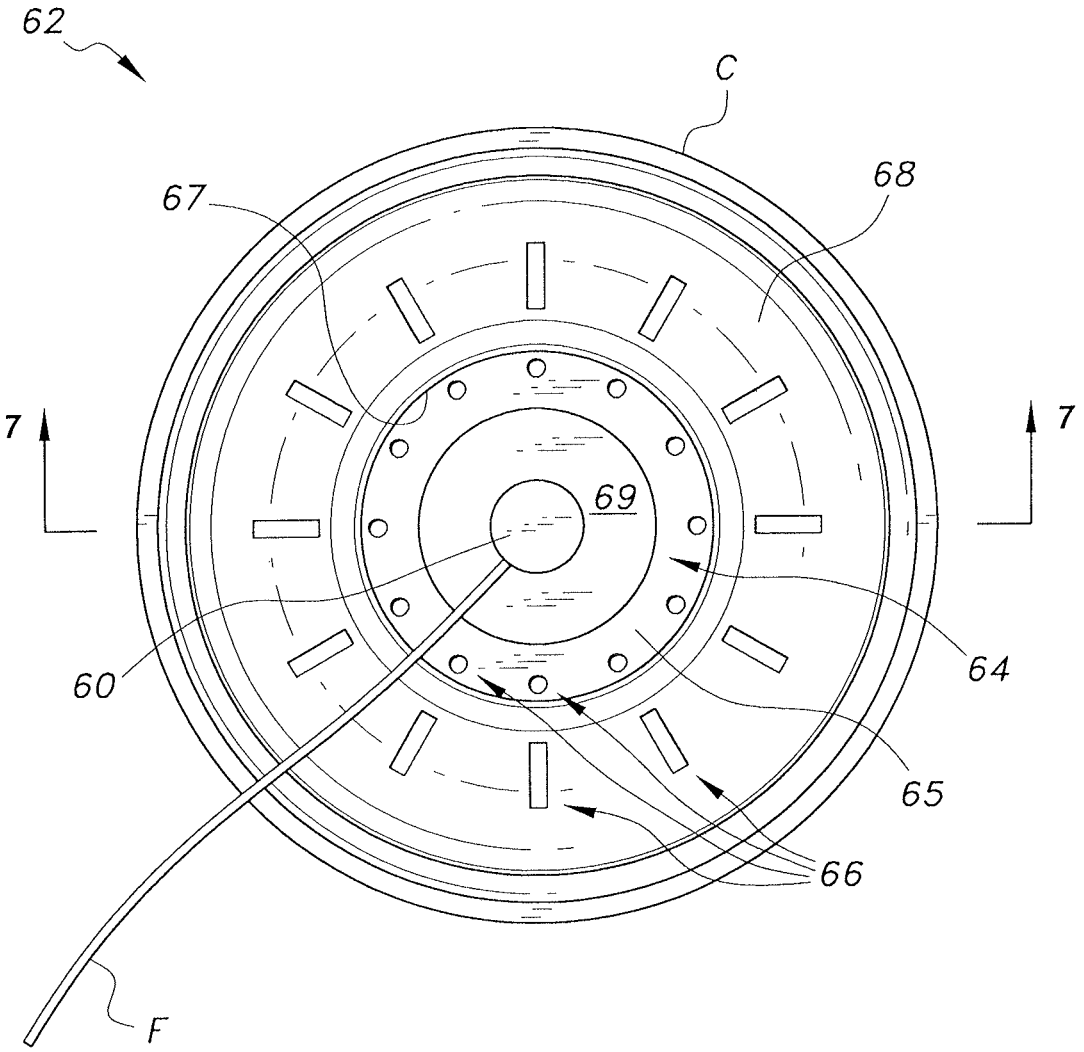
FIG. 6 is a diagrammatic environmental top view of an alternative embodiment of a ball retrieval attachment for golf flagstick, shown inserted in a golf cup.
Figure 7:
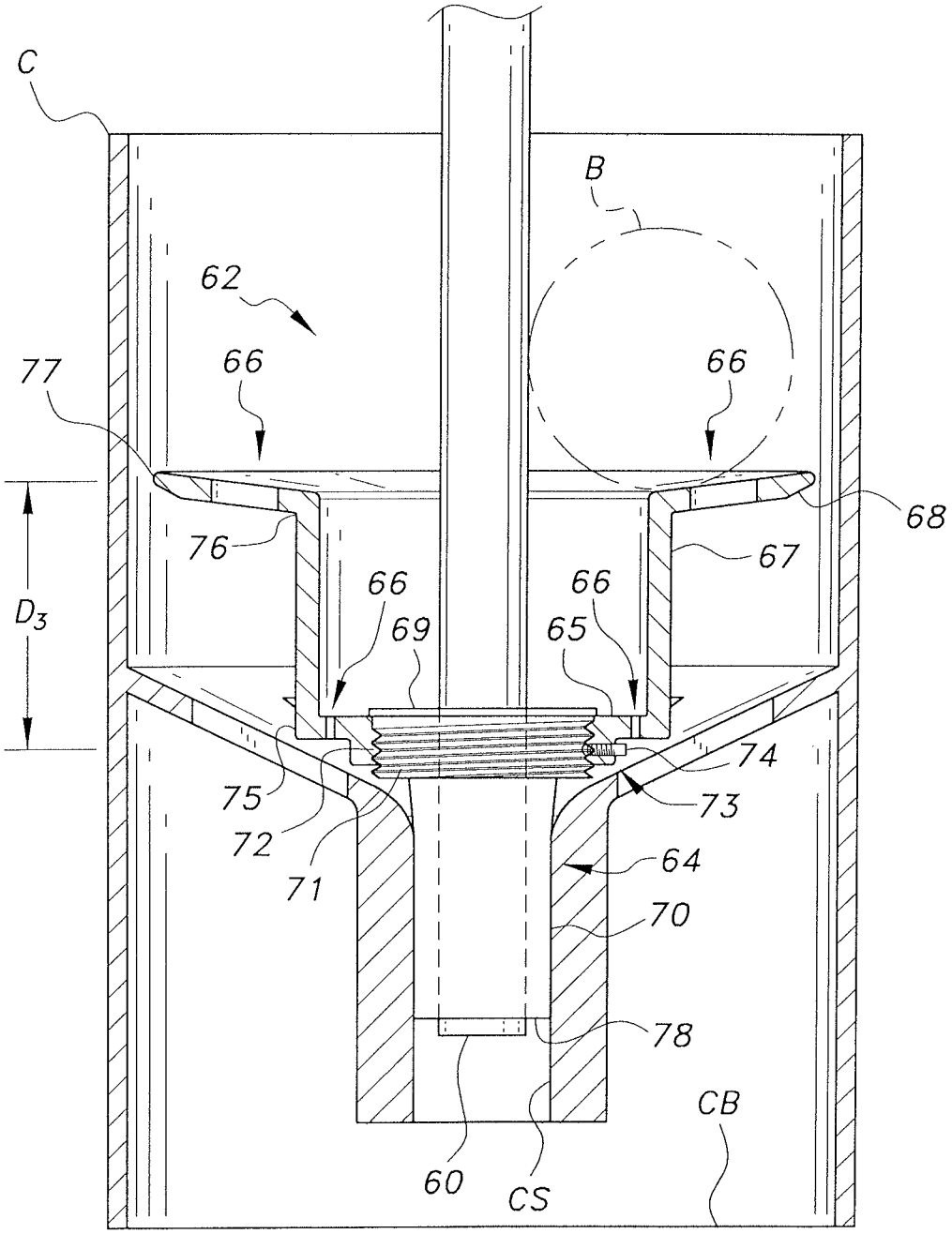
FIG. 7 is a section view drawn along lines 7-7 of FIG. 6.
Figure 8:
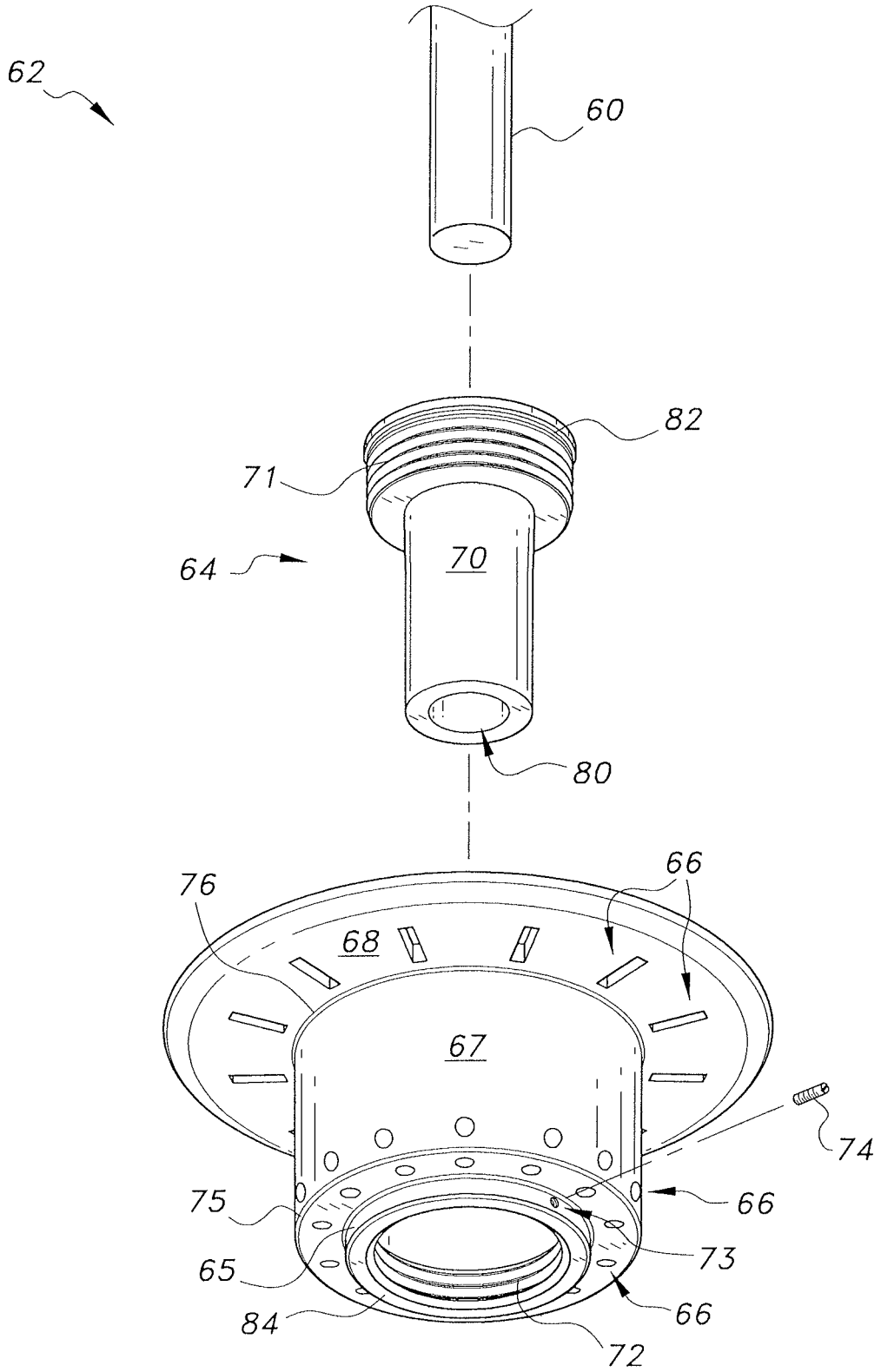
FIG. 8 is an exploded, perspective view of the ball retrieval attachment of FIG. 6.

In FIGS. 6-8, a third embodiment of the ball retrieval attachment 62 for golf flagstick is shown mounted on golf flagstick 60. In this embodiment, the ball retrieval attachment 62 is an integral unit (ball retrieval body) including a ball retrieval attachment hub 65 with internal threads 72, a frustoconical ball engagement surface or flange 68 and a cylindrical stem or riser portion or tube 67 having a lower end 75 attached to the ball retrieval attachment hub 65 and an upper end 76 attached to the ball engagement flange 68. The ball retrieval attachment hub 65 extends radially inward substantially perpendicular to the lower end 75 of the cylindrical riser portion 67. The ball retrieval attachment hub 65 includes a lower cylindrical extension 84 extending below the lower end 75 of the cylindrical riser portion 67, the lower cylindrical extension 84 having a set screw 74 that extends through a threaded bore 73 in the sidewall of the lower cylindrical extension 84 to lock the internal threads 72 of the ball retrieval attachment hub 65 to the external threads 71 on the flagstick ferrule 64 at a user-selectable height. The set screw 74 thereby provides a fine control of the height of the ball retrieval attachment 62 above the bottom 78 of the flagstick ferrule 64. The height of the riser portion 67 provides coarse adjustment of the height or distance $D_3$ of the outer edge 77 of the ball engagement flange 68 above the bottom 78 of the flagstick ferrule 64. This height must be selected at the time of manufacture and the ball retrieval attachment 62 may be provided by a manufacturer in a variety of heights, such that a consumer could select the appropriate height for their application. The frustoconical ball engagement flange 68 extends upward and outward from the upper end 76 of the cylindrical riser portion 67 at a slight angle to the horizontal, the ball-engaging surface of the flange 68 sloping inward to thereby urge the ball B against the flagstick 60 and away from the side of the cup C. A number of openings 66 extend through the ball retrieval attachment hub 65, the cylindrical riser portion 67 and the frustoconical ball engagement flange 68 to provide drainage of any water in the cup. The openings can be circular, polygonal, or may form alphanumeric shapes, such as a brand name or other marketing language.

In both the second and third embodiments, the external threads 40, 71 may be formed integrally on the flagstick ferrule at the bottom of a flagstick. Alternatively, the ball retrieval attachment 62 may include a flagstick ferrule 64 as shown in FIGS. 6-8. The flagstick ferrule 64 includes a lower frustoconical portion 70 that is slightly tapered and a top surface 69. The lower frustoconical portion 70 is tapered for insertion into the similarly tapered cup socket CS located in the cup bottom CB of the golf cup C to thereby support the golf flagstick 10, 60 in a vertical orientation. As shown in FIG. 8, the ferrule 64 includes an attachment boss at its upper end of wider diameter than the lower frustoconical portion, the attachment boss having external threads 71 that mate with the internal threads 72 of the ball retrieval attachment hub 65 and are integral with and above the lower frustoconical portion 70. An unthreaded annular cap portion 82 is mounted on top of the attachment boss. A longitudinal, cylindrical bore 80 extends through the lower frustoconical portion 70, attachment boss, and the unthreaded cap portion 82 for mounting the flagstick ferrule 64 on a flagstick 60. The unthreaded cap portion 82 limits the extent to which the ball retrieval attachment hub 65 can be screwed onto the flagstick ferrule 64, thereby providing an accurate placement of the ball engagement flange 68 above the bottom 78 of the flagstick ferrule 64. Alternatively, bore 80 may be a blind bore and the bottom of the flagstick 60 may contact the bottom of the blind bore. The flagstick ferrule 64 can be attached to an existing flagstick using an adhesive or other attaching mechanism to retrofit the ball retrieval attachment on the flagstick 60.

It is to be understood that the ball retrieval attachment for golf flagstick is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A ball retrieval attachment for a golf flagstick, comprising:

a ball retrieval body having a ball engagement surface;

a ball retrieval attachment hub below and supporting the ball retrieval body, the ball retrieval attachment being adapted for mounting on a golf flagstick for retrieving a golf ball from a golf cup, wherein the hub comprises internal threads adapted for engaging external threads on a ferrule mounted on the flagstick for attaching the ball retrieval attachment to the flagstick; and an extender having an upper end and a lower end, the extender defining a bore adapted for slidable mounting on the golf flagstick between the ball retrieval body and the ball retrieval attachment hub, the upper end of the extender having external threads releasably engaging the internal threads in the attachment hub, the lower end of the extender having internal threads defined in the bore adapted for engaging external threads on a ferrule mounted on the golf flagstick, the extender raising the height of said ball retrieval body on the golf flagstick.

2. The ball retrieval attachment according to claim 1, wherein said ball retrieval body comprises a concave annular disk made of fibrous material permitting drainage of water through the disk.

3. The ball retrieval attachment according to claim 2, wherein said ball retrieval body further comprises a plurality of reinforcement ribs extending radially from said hub under the disk.

4. The ball retrieval attachment according to claim 3, wherein the disk defines a circular perimeter, said ball retrieval body further comprising a memory spring wire extending around the perimeter of said body.

5. A golf flagstick, comprising:

an elongated movable pole having a top end adapted for attachment of a golf flag thereto and a bottom end adapted for insertion into a golf cup; and a ball retrieval attachment including:

a ball retrieval body having a ball engagement surface, the ball retrieval body being mounted on the bottom end of the pole for retrieving a golf ball landing in the golf cup on the ball engagement surface;

a ball retrieval attachment hub below and supporting the ball retrieval body, the ball retrieval attachment hub having a fastener for mounting the ball retrieval body at an adjustable height at the bottom end of the pole;

a cylindrical riser tube disposed between the ball retrieval body and the ball retrieval attachment hub, the cylindrical riser tube having an upper end and a lower end, the ball retrieval body comprising an annular frustoconical ball engagement flange mounted on and integral with the upper end of the cylindrical riser tube, the ball retrieval attachment hub extending radially inward from and substantially perpendicular to the lower end of the cylindrical riser tube, the ball retrieval attachment hub being integral with the cylindrical riser tube and having a lower cylindrical extension extending below the lower end of the cylindrical riser tube, the ball retrieval attachment hub and the lower cylindrical extension being internally threaded, the lower cylindrical extension having a set screw bore defined therein and a set screw mounted in the set screw bore, the set screw fixing the frustoconical ball engagement flange at a user-selectable height at the bottom end of said pole; and a flagstick ferrule having:

an externally threaded attachment boss threadably engaging the internal threads of the ball retrieval attachment hub; and a lower frustoconical portion extending below the attachment boss, the attachment boss and the lower frustoconical portion defining a continuous bore, the bottom end of the pole extending into the continuous bore, the lower frustoconical portion defining a taper dimensioned and configured for insertion into a cup socket of a golf cup.

6. The golf flagstick according to claim 5, wherein said ball retrieval body comprises a concave annular disk made of fibrous material permitting drainage of water through the disk.

7. The golf flagstick according to claim 6, wherein said ball retrieval body further comprises a plurality of reinforcement ribs extending radially from said hub under the disk.

8. The golf flagstick according to claim 7, wherein the disk defines a circular perimeter, said ball retrieval body further comprising a memory spring wire extending around the perimeter of said body.

9. The golf flagstick according to claim 5, further comprising an annular cap mounted on top of the attachment boss of said flagstick ferrule.

10. A ball retrieval attachment for a golf flagstick, comprising:

an integral ball retrieval attachment, the ball retrieval attachment including:

a ball retrieval body;

a ball retrieval attachment hub;

a cylindrical riser tube, the cylindrical riser tube having an upper end and a lower end, the cylindrical riser tube disposed between the ball retrieval body and the ball retrieval attachment hub, wherein the ball retrieval body is disposed at the upper end of the cylindrical riser tube and the ball retrieval attachment hub disposed at the lower end of the cylindrical riser tube, a portion of the ball retrieval attachment hub being internally threaded; and a flagstick ferrule adapted to be attached to and constrained upon a flagstick, the flagstick ferrule including:

a lower frustoconical portion adapted to be inserted into a similarly tapered cup socket of a golf hole thereby supporting the golf flagstick; and an attachment boss at the upper end of the flagstick ferrule, the attachment boss having external threads that mate with the internal threads of the ball retrieval attachment hub.

11. The ball retrieval attachment according to claim 10, wherein the ball retrieval attachment hub includes a lower cylindrical extension extending below the lower end of the cylindrical riser portion, the lower cylindrical extension having a threaded bore in a sidewall of the lower cylindrical extension, the threaded bore being adapted to receive a set screw therethrough to lock the internal threads of the ball retrieval attachment hub to the external threads on the flagstick ferrule at a user-selectable height.

12. The ball retrieval attachment according to claim 10, wherein the attachment boss at the upper end of the flagstick ferrule includes a cap portion, the cap portion being configured and dimensioned to limit the extent to which the ball retrieval attachment hub can be screwed onto the flagstick ferrule, thereby providing an accurate placement of the ball retrieval body above the bottom of the flagstick ferrule.

* * * * *